US007568317B2

(12) United States Patent
Longden

(10) Patent No.: US 7,568,317 B2
(45) Date of Patent: Aug. 4, 2009

(54) GLAZING CLIPS FOR ANCILLARY ELEMENTS ON GLAZING UNITS

(75) Inventor: Paul Longden, Ashby (GB)

(73) Assignee: The Real Georgian Bar Company Limited, Kent (GB)

( * ) Notice: Subject to any disclaimer, the term of this patent is extended or adjusted under 35 U.S.C. 154(b) by 498 days.

(21) Appl. No.: 10/520,748

(22) PCT Filed: Jul. 25, 2003

(86) PCT No.: PCT/GB03/03265

§ 371 (c)(1),
(2), (4) Date: Aug. 4, 2005

(87) PCT Pub. No.: WO2004/011756

PCT Pub. Date: Feb. 5, 2004

(65) Prior Publication Data

US 2006/0053719 A1 Mar. 16, 2006

(51) Int. Cl.
*E06B 3/964* (2006.01)
*E06B 3/70* (2006.01)
*E04C 2/38* (2006.01)

(52) U.S. Cl. ..... 52/204.61; 52/456; 52/656.8

(58) Field of Classification Search ..... 52/204.53, 52/204.61, 456, 660, 665, 734.1, 734.2, 656.5, 52/656.6, 656.8, 656.9
See application file for complete search history.

(56) References Cited

U.S. PATENT DOCUMENTS

| | | | | |
|---|---|---|---|---|
| 3,678,651 | A * | 7/1972 | Hicks | 52/204.61 |
| 4,028,849 | A * | 6/1977 | Anderson | 49/181 |
| 4,151,696 | A * | 5/1979 | Knights et al. | 52/745.15 |
| 4,989,384 | A * | 2/1991 | Kinghorn et al. | 52/456 |
| 6,026,621 | A * | 2/2000 | Fisher | 52/308 |
| 6,792,724 | B2 * | 9/2004 | Burgess | 52/204.61 |
| 2002/0104273 | A1 * | 8/2002 | Trpkovski | 52/172 |
| 2004/0216402 | A1 * | 11/2004 | Folsom et al. | 52/204.53 |

FOREIGN PATENT DOCUMENTS

| | | | |
|---|---|---|---|
| EP | 0 152 813 | A2 | 8/1985 |
| EP | 0152813 | A2 * | 8/1985 |
| EP | 0 641 913 | A2 | 3/1995 |
| GB | 2 070 118 | A | 9/1981 |
| WO | WO 01/61136 | A1 | 8/2001 |

* cited by examiner

*Primary Examiner*—Richard E Chilcot, Jr.
*Assistant Examiner*—Ryan D Kwiecinski
(74) *Attorney, Agent, or Firm*—Adams Intellectual Property Law, P.A.

(57) ABSTRACT

There is disclosed a glazing clip (2) for fitting about the edge of a glazing unit (60), the glazing clip (2) comprising means (6, 8) for interengaging with an ancillary element (40) on at least one side of a glazing unit, in use.

8 Claims, 11 Drawing Sheets

GLAZING CLIPS FOR ANCILLARY ELEMENTS ON GLAZING UNITS

This application is a national stage application, according to Chapter II of the Patent Cooperation Treaty.

FIELD OF THE INVENTION

The present invention relates to glazing clips, glazing assemblies, kits for the construction of ancillary elements on a glazing unit and to methods of construction of glazing assemblies.

BACKGROUND TO THE INVENTION

A typical glazing assembly comprises a sealed double glazed unit about the edge of which is provided a four-sided frame. The sealed glazing unit comprises a first glazing panel, typically of glass, in a spaced, parallel, face to face relationship with a similar second glazing panel. At the peripheral edge of the glazing panels and about their edges, a beading is provided, typically a poly vinyl chloride (PVC) material to maintain the spaced apart relationship and to prevent the ingress of water between the panels. The frame is typically a PVC moulding with PVC nitrile gaskets for receiving the glazing unit. A first side of a glazing unit is intended to be an interior panel and a second side as exterior panel, in use.

Some customers desire an effect on their windows such as the appearance of a Georgian bar thereon. A Georgian bar is a cross or trellis effect on the glazing assembly giving the appearance that the glazing is made up of multiple smaller glazing panels in a plane.

For reasons of manufacturing complexity, it is undesireable to manufacture genuine Georgian windows, but the appearance is often sought.

It is an aim of preferred embodiments of the present invention to obviate or overcome a problem associated with the prior art, whether referred to herein or otherwise.

SUMMARY OF THE INVENTION

According to the present invention in a first aspect, there is provided a glazing clip for fitting about the edge of a glazing unit, the glazing clip comprising means for interengaging with an ancillary element on at least one side of a glazing unit, in use.

Suitably, the glazing clip comprises means for interengaging with an ancillary element on both sides of a glazing unit.

Suitably, the glazing clip comprises a generally U-shaped body. The base of the U-shape extends across the edge of the glazing unit, in use, with each arm extending over the respective external face of the glazing panel on opposite sides thereof. Suitably, arms of the glazing clip are inclined from the perpendicular relative to the base, whereby in use the glazing clip is biased to the glazing unit.

Suitably, the interengaging means comprises an upstanding portion. This is for interengaging with a corresponding portion on an ancillary element. Suitably, the upstanding portion comprises a plurality of rebated portions.

Suitably, the upstanding portion comprises a mushroom formation.

Suitably, the glazing clip consists of a thermoplastic material.

According to the present invention in a second aspect, there is provided a kit for the construction of an ancillary element on a glazing unit, the kit comprising a plurality of glazing clips according to the first aspect of the present invention.

Suitably, the kit further comprises a cross-piece for interengaging with a first ancillary element in a first direction and with a second ancillary element in a second direction. This is used where the ancillary elements are made to appear to cross on the final glazing assembly. Suitably, the cross-piece comprises a first interengaging member for interengaging with a first ancillary element and a second interengaging member for interengaging with a second ancillary element. Suitably, the cross-piece further comprises a third interengaging member for interengaging with a third ancillary element. Suitably, the cross-piece is configured whereby a first ancillary element will be substantially perpendicular to a second and a third ancillary element. Suitably, the first interengaging member is substantially similar in cross-section to the second interengaging member. Suitably, the first interengaging member is substantially similar in cross-section to the third interengaging member. Suitably, the first interengaging member is substantially perpendicular to the second interengaging member.

Suitably, the first interengaging member is substantially perpendicular to the third interengaging member.

Suitably, the glazing clips in the kit are substantially similar.

Suitably, the kit additionally comprises at least one ancillary element for interengaging with the glazing clips. Suitably, the ancillary element is for a Georgian effect glazing assembly. Suitably, the ancillary element is of substantially constant cross-section. Suitably, the ancillary element comprises a female interengaging member for interengaging with a male interengaging member of a glazing clip. Alternatively, the ancillary element comprises a male interengaging member for interengaging with a female interengaging member of a glazing clip.

Suitably, the ancillary element comprises a lower face to be against a glazing panel in use, and the glazing clip is configured to interengage with the ancillary element in the lower face. Suitably, the lower face has a longitudinal slot therein for receiving the glazing clip. Suitably, the ancillary element and glazing clip interengage by a snap-fit connection.

According to the present invention in a third aspect, there is provided a glazing assembly comprising a glazing unit about the edge of which is at least one glazing clip according to the first aspect of the present invention and at least one ancillary element engaged with the glazing clip.

Suitably, the ancillary element is engaged with a first glazing clip and a second glazing clip after each has been placed about the glazing unit.

Suitably, the glazing assembly comprises a frame about the glazing unit.

The glazing assembly may be modified using a kit according to the second aspect of the present invention.

According to the present invention in a fourth aspect, there is provided a method of construction of a glazing assembly, the method comprising the steps of providing a glazing clip according to the first aspect of the invention to the edge of a glazing unit and engaging an ancillary element therewith.

Suitably, a plurality of glazing clips are provided to support the ancillary element.

Suitably, a plurality of ancillary elements are provided. Suitably, the ancillary elements are configured to meet and a cross-piece is provided to engage with ancillary elements in the region of the meeting of the ancillary elements.

BRIEF DESCRIPTION OF THE DRAWINGS

The present invention will now be described by way of example only, with reference to the drawings that follow; in which.

DESCRIPTION OF THE PREFERRED EMBODIMENTS

Figure 1:
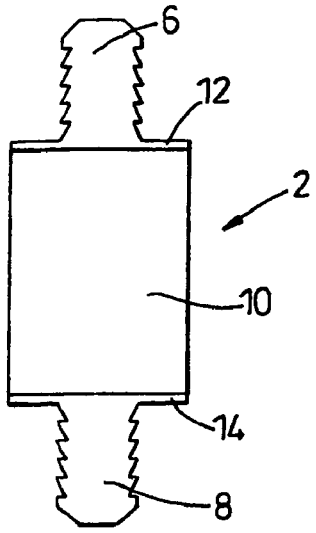
FIG. 1 is a front view of a glazing clip according to the present invention.
Figure 2:
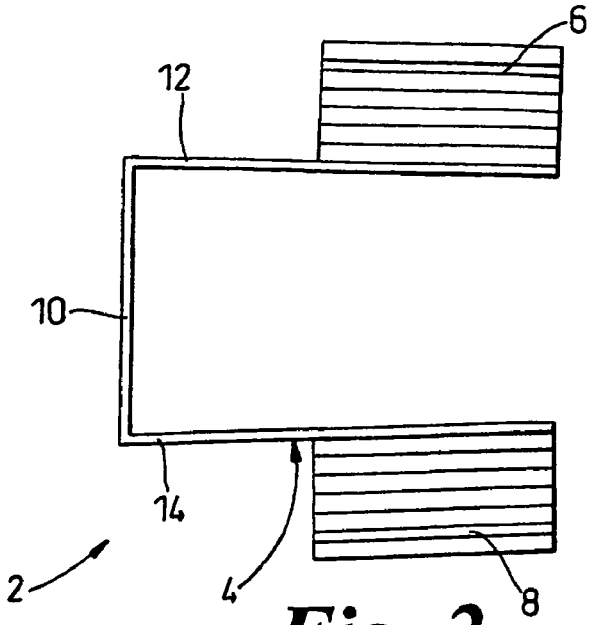
FIG. 2 is a side view of the glazing clip shown in FIG. 1.
Figure 3:
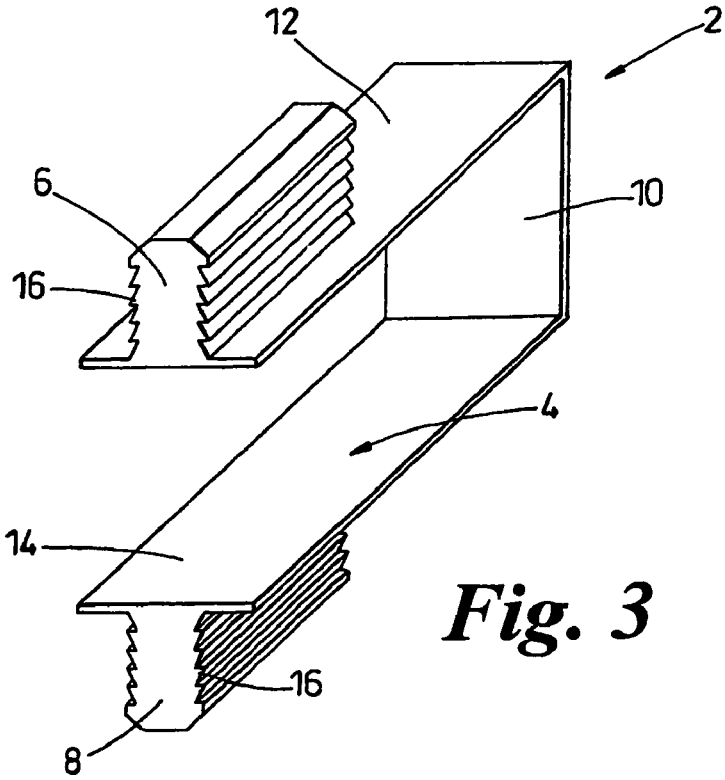
FIG. 3 is a perspective view of the glazing clip shown in FIGS. 1 and 2.

Referring to FIGS. 1-3 of the drawings that follow, there is shown a glazing clip 2 having a generally U-shaped body 4 from which extend means for interengaging with an ancillary element. The means for interengaging with an ancillary element comprise a first interengaging member 6 and a second interengaging member 8.

The generally U-shaped body 4 comprises a base 10 from which extend two substantially similar arms 12, 14 towards the distal end of which the first and second interengaging members 6, 8 lie.

As shown most clearly in FIG. 2 of the drawings, the arms 12, 14 of the U-shaped body 4 are inclined slightly from perpendicular with the base 10. That is the gap between the distal end of the arms 12, 14 is less than the distance between the other end of the arms 12, 14 at the base end.

Each interengaging member 6, 8 comprises an upstanding portion extending from the corresponding arm 12, 14, which upstanding portion comprises a male member (for interengagement with a female member as described below), which has a plurality of rebated portions therefore. The first and second interengaging members extend for just over half the length of the arms 12, 14 from the distal end thereof.

The glazing clip is formed from a rigid thermoplastic material by injection moulding.

Figure 4:
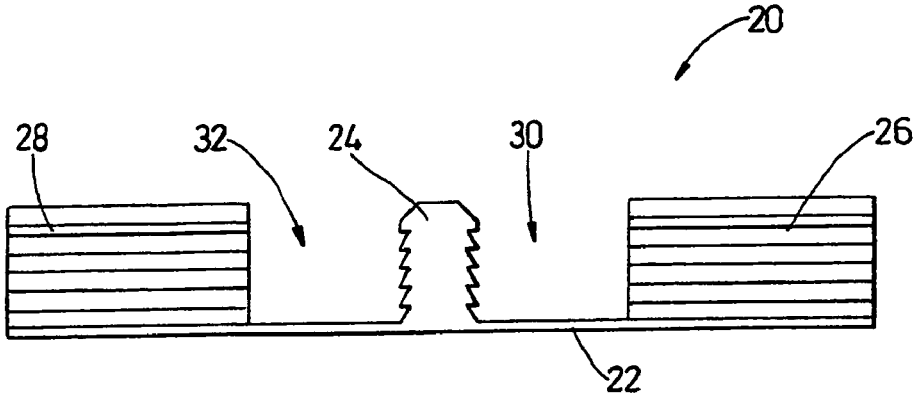
FIG. 4 is a front view of a cross-piece for use with the present invention.
Figure 5:
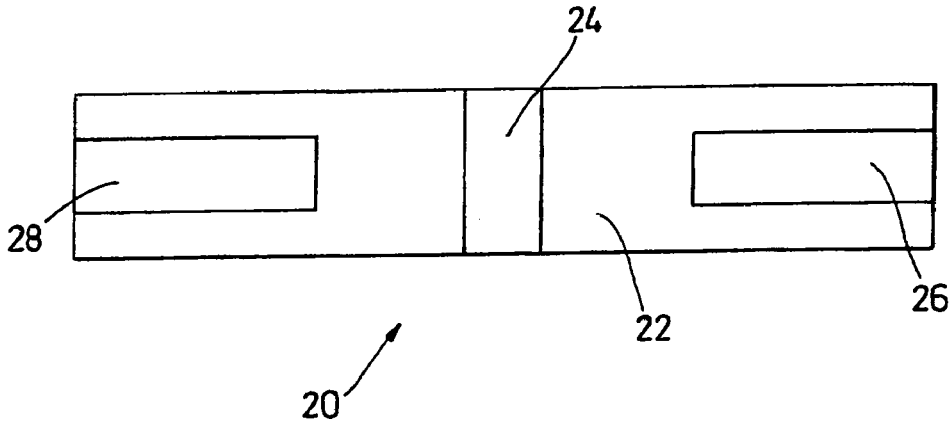
FIG. 5 is a side view of the cross-piece shown in FIG. 4.

Referring to FIGS. 4 and 5 of the drawings that follow, there is shown a cross-piece 20. The cross-piece 20 comprises a planar base 22 upstanding from which is a first interengaging member 24, a second interengaging member 26 and a third interengaging member 28. The base 22 is generally an elongate rectangle across the width of which extends first interengaging member 24. Generally perpendicular to the first interengaging member 24 and running parallel to the length of base 22 are second and third interengaging members 26, 28. Corresponding gaps 30, 32 are provided between first and second and first and third interengaging members. Interengaging members 24, 26, 28 are substantially similar to the interengaging members 6, 8 of glazing clip 2.

Figure 6:
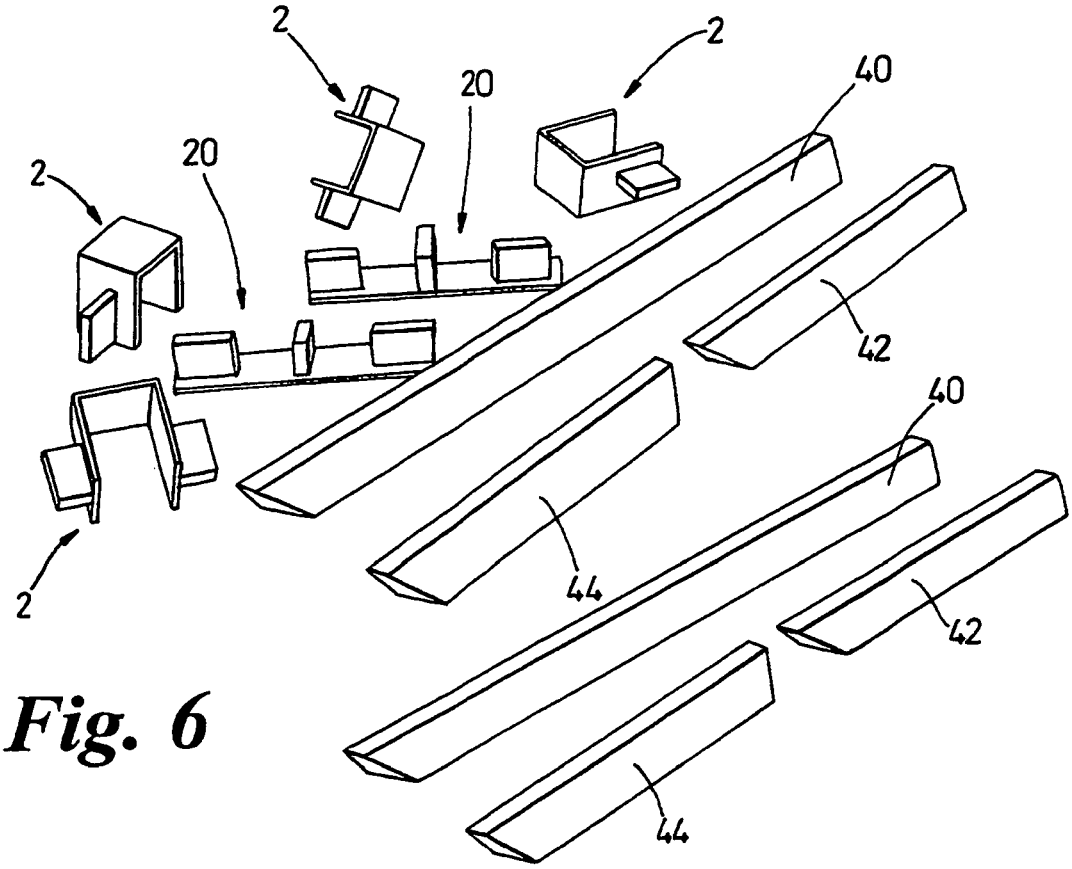
FIG. 6 is a perspective view of a kit according to the present invention.

Referring to FIG. 6 of the drawings that follow, there is shown a kit of parts according to the present invention, the kit comprising four substantially similar glazing clips 2, two cross pieces 20 and two lots of three ancillary elements 40, 42, 44 cut to length. It is noted that an ancillary element may be provided as a single piece and cut to suitable lengths on site.

Figure 7:
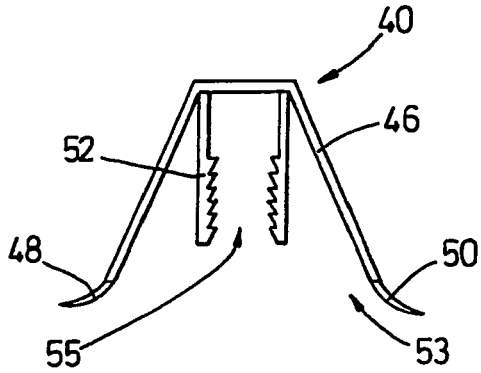
FIG. 7 is a cross-sectional elevation of an ancillary element for use with the present invention.

A known ancillary element 40 is shown in FIG. 7 for producing a Georgian bar effect. Each ancillary element is of a substantially similar cross-section. The ancillary element 40 comprises a generally n-shaped Georgian bar cover 46 with co-extruded gaskets 48, 50 extending from the depending arms thereof. In the interior (in use) of the ancillary element 40 there is a female part of an interengaging member 52 suitable for interengaging with any of the interengaging members of the glazing clip 2 or cross-piece 20. The ancillary element 40 has a lower face 53 intended, in use, to lie against or over a glazing panel, as described below. The width of body 4 of glazing clip 2 is no more than the width of the ancillary element so the latter substantially hides the former in use.

A method of usage of the preferred embodiment of the present invention will now be described with reference to FIGS. 8-13 of the drawings that follow.

Figure 8:
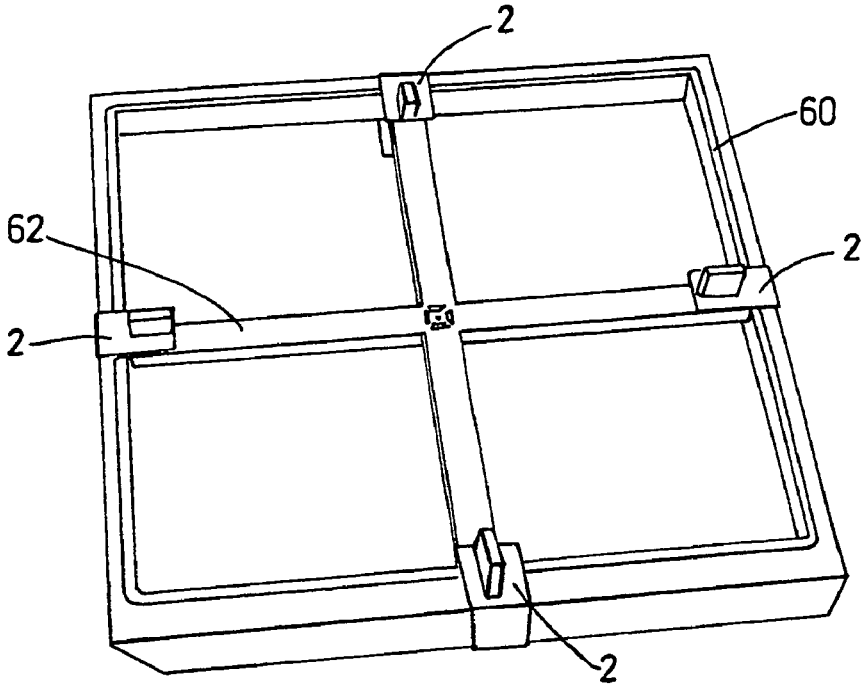
FIG. 8 is a perspective view of a first stage in a method of construction according to the present invention.

Referring to FIG. 8 of the drawings that follow, a glazing unit 60 is a double glazing unit of known type with interior (ie between the two glazing panels) cross members, an internal Georgian bar 62. The interior cross members are a known optional but desirable feature to enhance the final appearance of the product.

In the first step of construction of a glazing assembly according to the present invention, glazing clips 2 are fitted to each edge of the glazing unit 60 to suit the position of the internal Georgian bar 62. The slight incline of the arms 12, 14 of the glazing clips 2 means that once the four clips 2 have been slid over the edge of glazing unit 60 they hold themselves in place.

Accordingly a glazing clip 2 is provided over each edge of the glazing unit 60 with an interengaging means on each side of the glazing unit 60. That is, first interengaging member 6 is on one side of the glazing unit and second interengaging member 8 is on the other side of the glazing unit.

If there is no internal Georgian bar 62 then the glazing clips 2 are fitted around the sealed glazing unit 60 to suit the position of the spacer bar.

Figure 9:
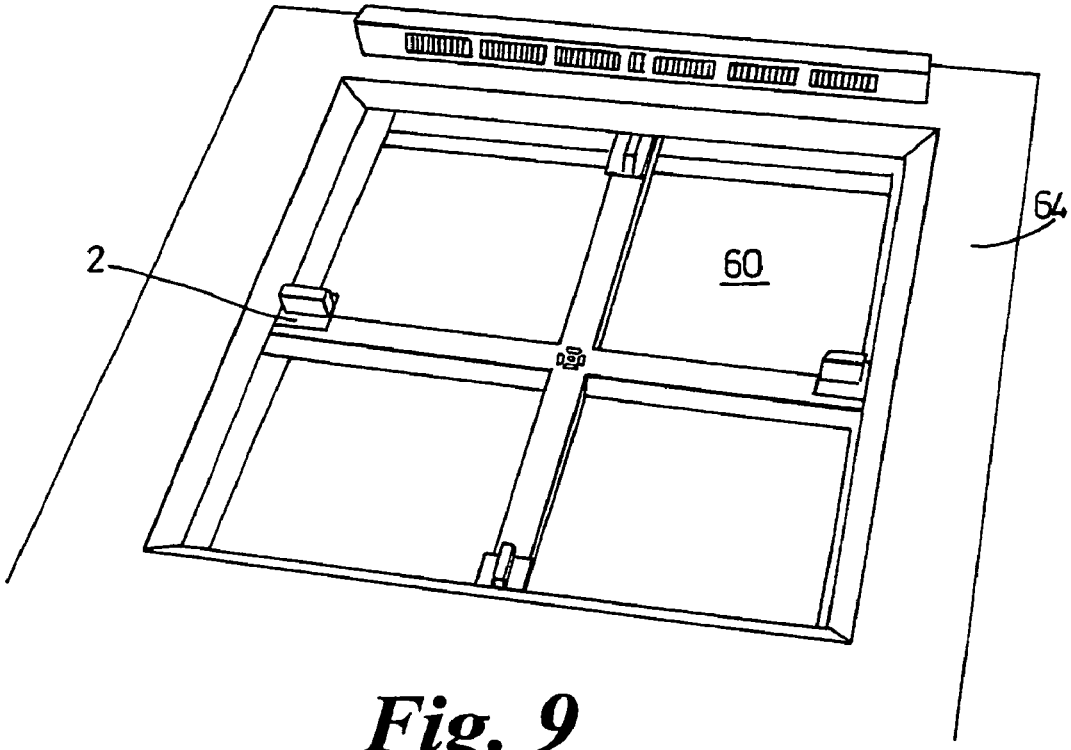
FIG. 9 is a perspective view of a second stage in a method of construction according to the present invention.

Referring to FIG. 9 of the drawings that follow, in the next step the glazing unit 60 is installed into a known frame 64 in the normal manner. It is recommended that it is checked that the clips 2 are in the right position before final beading of the assembly is carried out.

It is noted that the frame 64 incorporates gasket elements (not shown) for receiving the glazing unit 60 therein, which gaskets provide sufficient leeway for the relatively thin (typically, the wall size is 1 mm) glazing clips 2 to extend across the edge of the glazing unit 60 without interfering with the fitting of the glazing unit 60 in the frame 64.

Figure 10:
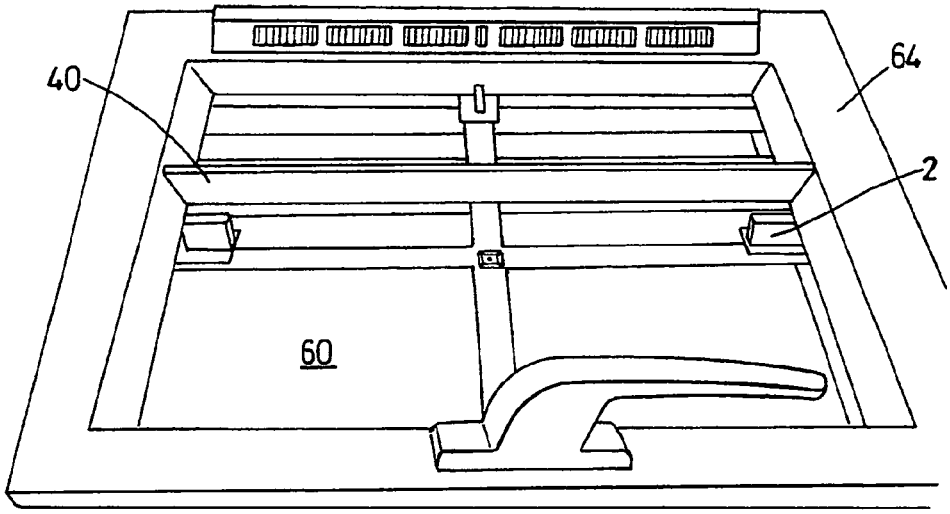
FIG. 10 is a perspective view of a third stage in a method of construction according to the present invention.

Referring to FIG. 10 of the drawings that follow, in a next step the shortest full span ancillary element 40, which will be one of the final external Georgian bar elements, is cut (if required) and mitred (if required) to the length required for fitting into the frame 64.

Figure 11:
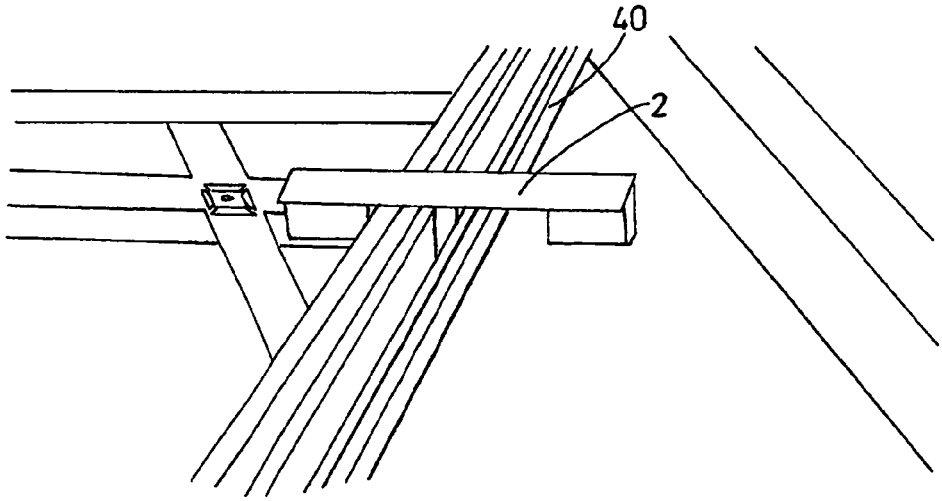
FIG. 11 is a perspective view of a fourth stage in a method of construction according to the present invention.

Next, with reference to FIG. 11 of the drawings that follow, the cross-piece 20 is fitted with first interengaging member in the female interengaging member 52 thereof. The cross-piece 20 is located centrally on the ancillary element 40. The ancillary element 40 is then push fitted as a snap-fit on to the exposed interengaging members 6 of the glazing clips 2.

Figure 12:
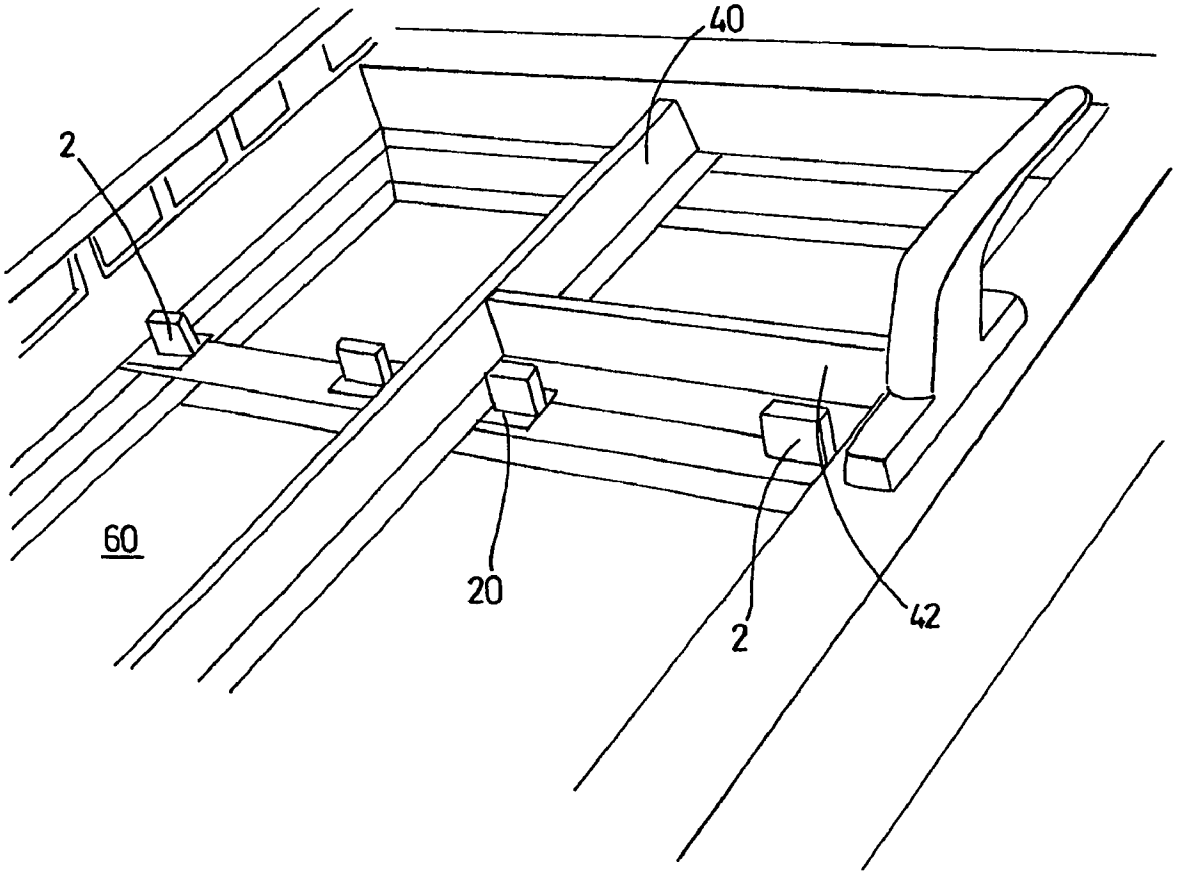
FIG. 12 is a perspective view of a fifth stage in a method of construction according to the present invention.
Figure 13:
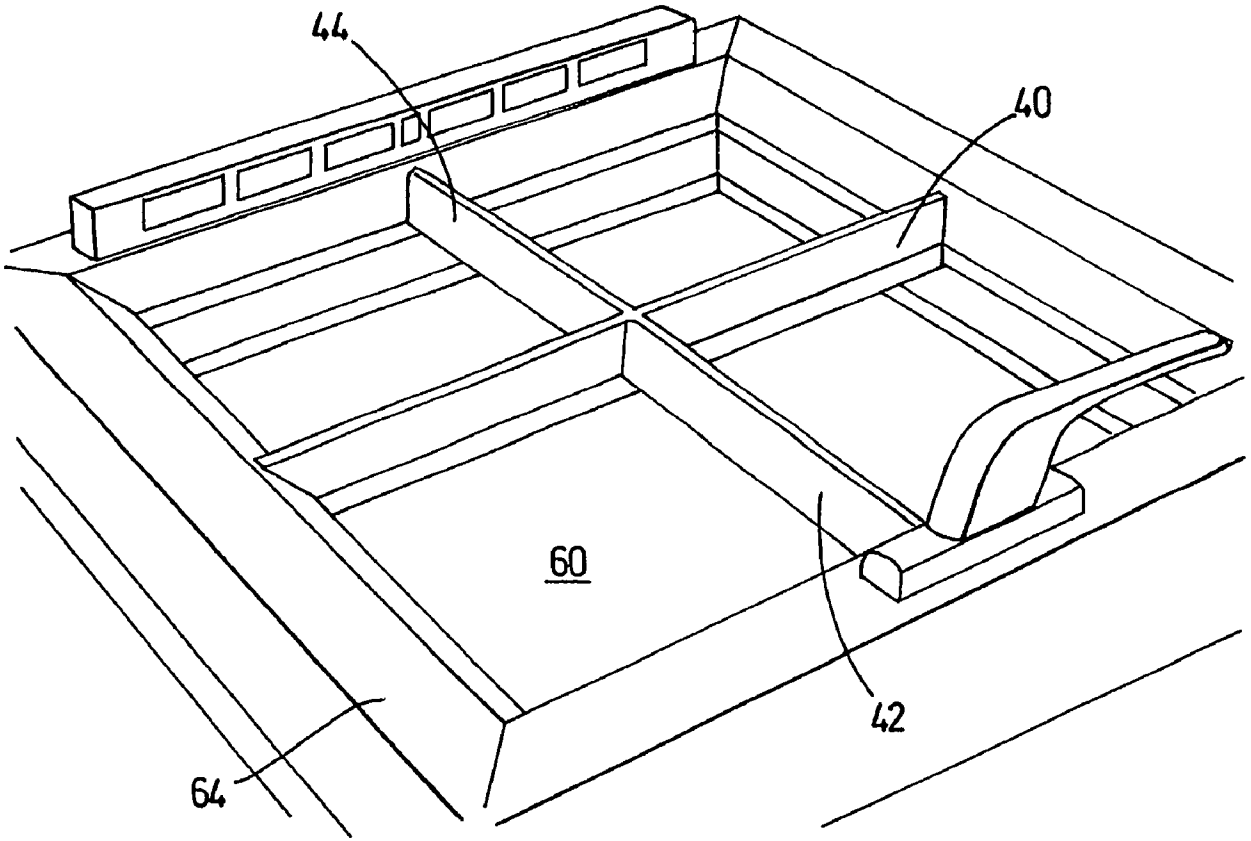
FIG. 13 is a perspective view of a sixth stage in a method of construction according to the present invention.

In the next step as shown with reference to FIGS. 12 and 13 of the drawings that follow, the remaining ancillary elements 42 and 44 are, if necessary, cut to length and mitred. Ancillary elements 42, 44 are then push fitted on to interengaging members 6 (of glazing clips 2) and the second and third interengaging members 26, 28 of the cross-piece.

The lower face 53, therefore lies against the glazing panel 60. The interengaging member 6 thus interengages with the ancillary element 42 in the lower face 53 thereof by a snap fit connection. Thus a longitudinal slot 55 is provided to receive interengaging means 6.

Thus, one side of the glazing unit has the appearance of a Georgian bar with a single cross.

The procedure is then repeated on the reverse side of the glazing unit 60 for the ancillary elements therefor.

For multiple cruciform configurations the process is repeated at every junction. It is recommended that the shortest full span for a continual ancillary element bar is used to maximise the rigidity of the system. If required a small double sided tape patch (not shown) may be applied at each cross piece between the cross piece and the glazing panel, or alternatively a thin bead of translucent silicone (not shown) may be used. This helps secure the cross piece in the long term and reduces the risk of rattling.

Figure 14:
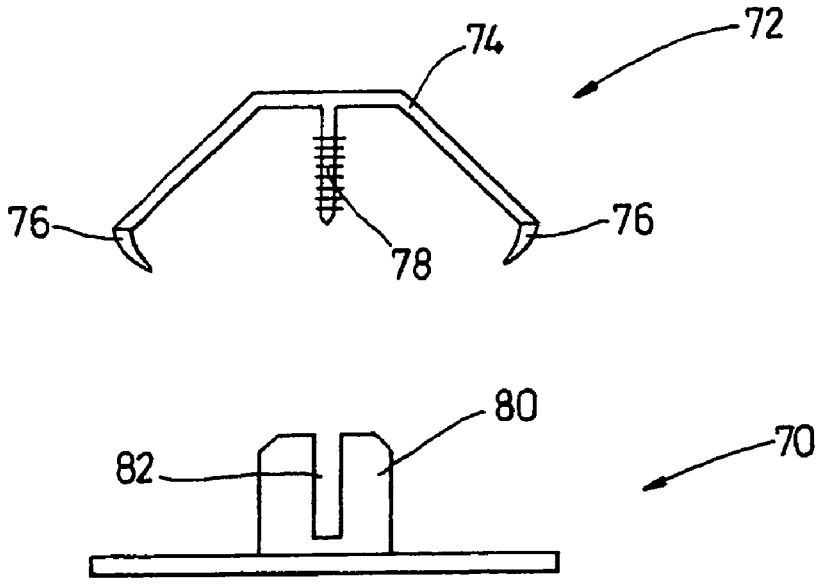
FIG. 14 is a front view of a glazing clip and corresponding ancillary element according to another embodiment of the present invention.

Referring to FIG. 14 of the drawings that follow, there is shown a glazing clip 70 for use with a known aluminium ancillary element 72, the latter comprising an aluminium body 74 from which extend co-extruded gaskets 76. The interengaging member is a serrated male part 79. In this FIG. 14 and FIG. 15 that follows, only one arm of the respective glazing clip is shown as the variation thereof is to the respective interengaging members. On each glazing clip each interengaging member is similar. Correspondingly similar interengaging members are used on the respective cross-pieces (not shown) which are modified accordingly. The glazing clip 70 is modified to have a female interengaging member 80 with a slot 82 into which the male part 78 fits, the serrations engaging with the plastic of the female part 80.

Figure 15:
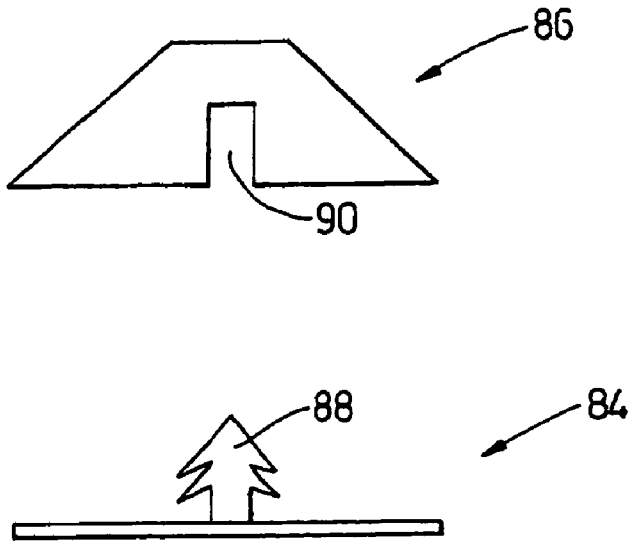
FIG. 15 is a front view of a glazing clip and corresponding ancillary element according to a further embodiment of the present invention.

Referring to FIG. 15 of the drawings that follow, there is shown part of another glazing clip 84 for use with a known wooden ancillary element 86. In this case the clip 84 has an upstanding "fir tree" 88 for interengaging in a female slot 90 in ancillary element 86.

Figure 16:
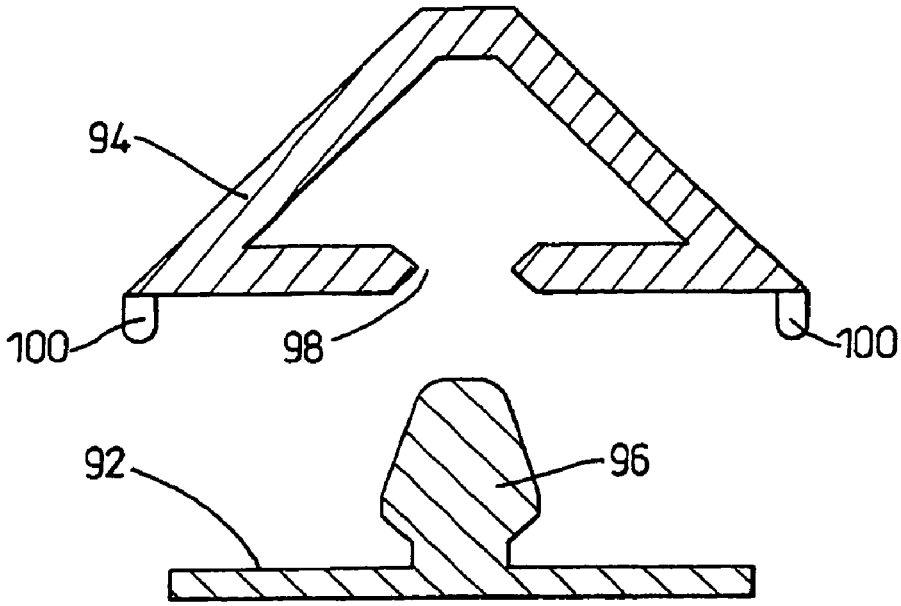
FIGS. 16 and 17 are cross-sectional elevations of an alternative clip and ancillary element configurations.
Figure 17:
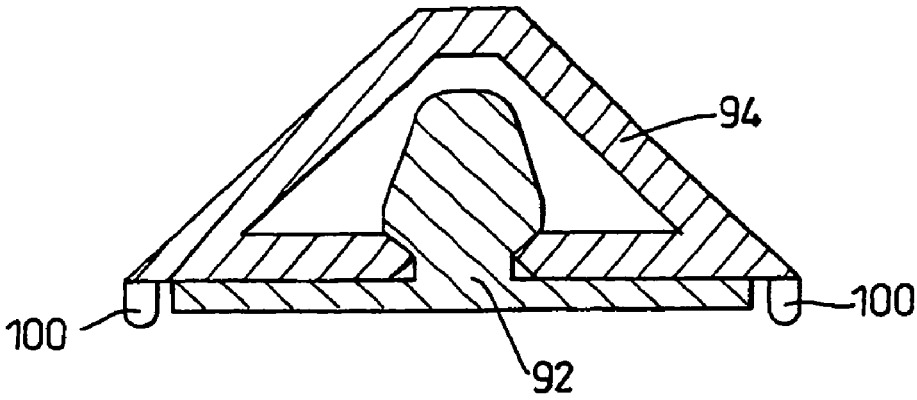

Referring to FIGS. 16 and 17 of the drawings that follow, there is shown part of another glazing clip 92 in cross section, showing a limb thereof together with a corresponding ancillary element 94. Glazing clip 92 includes an elongate mushroom head formation 90 as an interengaging means for push and snap fitting into a slot 98 as shown in FIG. 17. Ancillary element 94 comprises a generally triangular in cross-section, open bottomed shape with depending co-extruded gasket 100.

This formation of interengaging means provides for a lower, in terms of the amount of protrusion from the surface of the glazing panel, in use, Georgian bar effect.

Figure 18:
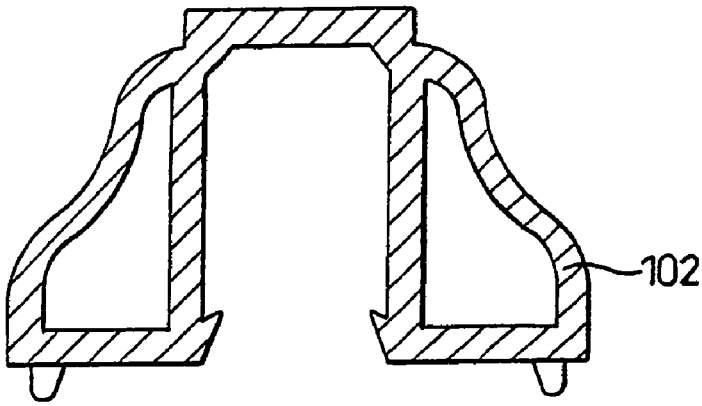
FIGS. 18-20 are cross-sectional elevations of alternative ancillary elements.
Figure 19:
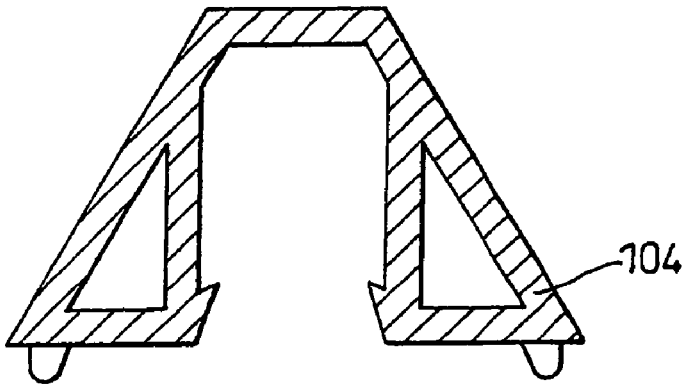
Figure 20:
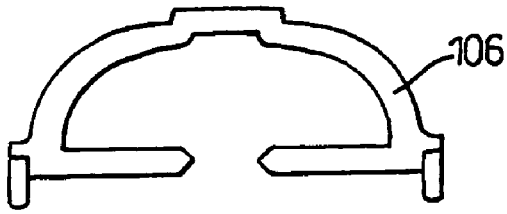

FIGS. 18, 19 and 20 of the drawings that follow illustrate alternative "low" ancillary elements 102, 104 and 106 respectively, with modified profiles.

Figure 21:
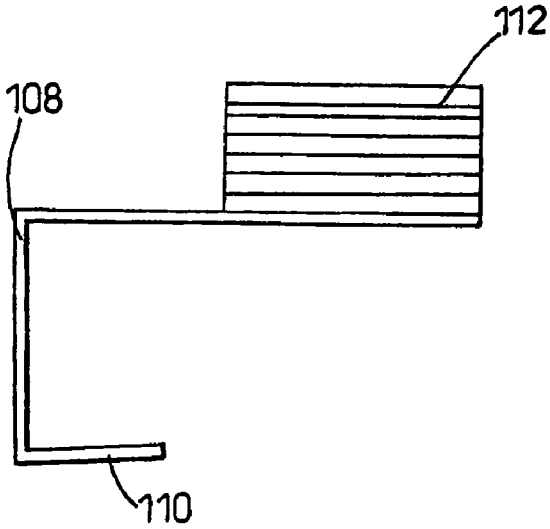
FIGS. 21 and 22 are side and front elevations respectively of modified glazing clips according to the present invention.
Figure 22:
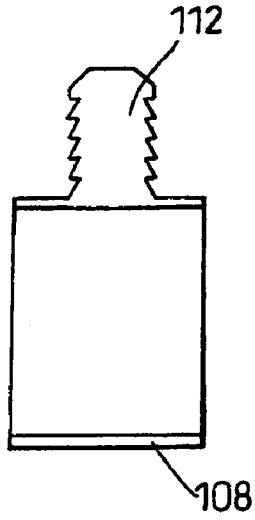

FIGS. 21 and 22 of the drawings that follow show in end and front elevations a glazing clip for use when an ancillary element is desired on one side of a glazing panel only. In this embodiment, one limb 110 is truncated and an interengaging means 112 is provided on one side only.

It is noted that the slot in the at least partly open lower face of the ancillary element may be across the full (FIG. 7) or partial (FIGS. 16-20) width of the lower face.

Thus, by using embodiments of the present invention a single glazing clip can provide interengaging members on one or both sides of a glazing unit. The interengaging members are inherently aligned and do not interfere with the frame because of the thin body of the clip. A pleasing Georgian effect window assembly can, therefore, be provided.

It will be appreciated that the present invention is suitable for glazing units having any number of glazing panels from one upwards, requiring only an adjustment of the length of the base. It will also be appreciated that the order of the method of construction described above can be altered somewhat if desired.

The reader's attention is directed to all papers and documents which are filed concurrently with or previous to this specification in connection with this application and which are open to public inspection with this specification, and the contents of all such papers and documents are incorporated herein by reference.

All of the features disclosed in this specification (including any accompanying claims, abstract and drawings), and/or all of the steps of any method or process so disclosed, may be combined in any combination, except combinations where at least some of such features and/or steps are mutually exclusive.

Each feature disclosed in this specification (including any accompanying claims, abstract and drawings), may be replaced by alternative features serving the same, equivalent or similar purpose, unless expressly stated otherwise. Thus, unless expressly stated otherwise, each feature disclosed is one example only of a generic series of equivalent or similar features.

The invention is not restricted to the details of the foregoing embodiment(s). The invention extends to any novel one, or any novel combination, of the features disclosed in this specification (including any accompanying claims, abstract and drawings), or to any novel one, or any novel combination, of the steps of any method or process so disclosed.

The invention claimed is:

1. A false muntin glazing assembly for being fitted onto a glazing unit having two spaced-apart faces separated by a frame to provide the appearance of a glazing assembly having divided lights, comprising:

(a) a U-shaped muntin clip for being positioned onto the glazing unit, and having a base engaging the frame and two arms spaced-apart for extending from the frame onto the faces of the glazing unit;

(b) the arms having at least one longitudinally-extending locking tab for projecting outwardly away from respective ones of the two faces of the glazing unit, the locking tabs having a guide recess of reduced width along its length, the width of the guide recess being less than the width of the arms to define opposing guide surfaces on the arms along the length thereof on opposite sides of the locking tabs; and (c) a decorative muntin piece for being positioned on the muntin clip to engage and extend along a length of one of the faces of the glazing unit, and comprising an elongate member having a channel extending along its length for being aligned with one of the arms of the muntin clip and driven along the length of the muntin clip on the locking tab, the channel having a width complementary to the width of the locking tab for being locked onto the locking tab, the muntin piece having elongate edge surfaces extending along its length on opposite sides of the channel for sliding along the opposing guide surfaces on the arms into a use position in engagement with the face of the glazing unit.

2. A false muntin glazing assembly according to claim 1, wherein the muntin piece includes sealing strips extending along respective ones of the edge surfaces distal from the channel and having a thickness substantially the same as a thickness dimension of a respective one of the arms of the muntin clip for permitting the muntin piece to sealingly engage the face along which it extends.

3. A false muntin glazing assembly according to claim 1, including a plurality of muntin clips and first muntin pieces, wherein the first muntin pieces have a length adapted to extend across a first dimension of the glazing unit from one side edge to an opposing side edge, and further including a plurality of second muntin pieces have a length adapted to extend across a second dimension of the glazing unit perpendicular to the first dimension and perpendicularly engage a side of one of the first muntin pieces extending along the first dimension of the glazing unit.

4. A false muntin glazing assembly according to claim 3, and including a planar muntin clip for securing a second muntin piece to the face proximate the first muntin piece.

5. A false muntin glazing assembly according to claim 3, and including a planar muntin clip for securing two of the second muntin pieces to the face proximate opposing sides of the first muntin piece, and comprising a base for being positioned under the first muntin piece and against the face of the glazing strip, and having two spaced-apart longitudinally-extending locking tabs for projecting outwardly away from the face of the glazing unit on opposite sides of the first muntin strip, the locking tabs having a guide recess of reduced width along its length, the width of the guide recess being less than the width of the arms to define opposing guide surfaces on the arms along the length thereof on opposite sides of the locking tabs for receiving the muntin piece thereon.

6. A false muntin glazing assembly according to claim 1, and including an enlarged head portion on the locking tab.

7. A false muntin glazing assembly according to claim 6, wherein the enlarged head includes a plurality of serrated teeth formed thereon and extending outwardly therefrom.

8. A false muntin glazing assembly according to claim 1, wherein the muntin clip and decorative muntin piece are each fabricated of a plastic material.

* * * * *